US006925819B2

(12) United States Patent
Ingley, III et al.

(10) Patent No.: US 6,925,819 B2
(45) Date of Patent: Aug. 9, 2005

(54) SYSTEM FOR TRAPPING AIRBORNE WATER IN COOLING AND FREEZING DEVICES

(75) Inventors: Herbert A. Ingley, III, Gainesville, FL (US); Sherif A. Sherif, Ocala, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 0 days.

(21) Appl. No.: 10/665,047

(22) Filed: Sep. 19, 2003

(65) Prior Publication Data

US 2005/0061015 A1 Mar. 24, 2005

(51) Int. Cl.[7] ..... F25D 21/06
(52) U.S. Cl. ..... 62/89; 62/276; 55/524
(58) Field of Search ..... 55/524; 62/234, 62/276, 418

(56) References Cited

U.S. PATENT DOCUMENTS 2,494,074 A * 1/1950 Weiss ..... 62/417
2,546,417 A * 3/1951 Anglin ..... 62/281
3,301,004 A * 1/1967 Winkelhaus-Elsing ..... 62/408
3,333,437 A 8/1967 Brennan
3,763,633 A * 10/1973 Soltis ..... 96/58
4,759,782 A * 7/1988 Miller et al. ..... 55/487
5,257,510 A 11/1993 Cox
5,675,984 A * 10/1997 Shin ..... 62/276
5,755,104 A 5/1998 Rafalovich et al.
6,266,969 B1 7/2001 Malnati et al.
6,467,282 B1 10/2002 French et al.
6,497,108 B2 12/2002 Collins et al.
6,694,765 B1 * 2/2004 Waldschmidt et al. ..... 62/234

FOREIGN PATENT DOCUMENTS

| | | |
|---|---|---|
| EP | 0031311 | 7/1981 |
| GB | 2165341 | 8/1985 |
| WO | PCT/US04/030652 | 11/2004 |

* cited by examiner

*Primary Examiner*—William E. Tapolcai
(74) *Attorney, Agent, or Firm*—Akerman Senterfitt

(57) ABSTRACT

A refrigeration system trapping device and method traps airborne liquid water and ice particles before they accumulate on evaporator coils, reducing frost deposition on the evaporator. The frost on the trapping device can be actively removed.

16 Claims, 3 Drawing Sheets

SYSTEM FOR TRAPPING AIRBORNE WATER IN COOLING AND FREEZING DEVICES

CROSS REFERENCE TO RELATED APPLICATIONS

Not applicable.

STATEMENT AS TO FEDERALLY SPONSORED RESEARCH OR DEVELOPMENT

Not applicable.

FIELD OF THE INVENTION

This invention relates generally to methods and devices for prevention of frost or ice deposition on cold surfaces such as evaporator and freezer coils in refrigeration devices. More specifically, the invention relates to methods, systems and devices for trapping airborne water and ice crystals prior to their deposition on such surfaces.

BACKGROUND

Refrigerators, freezers and air conditioners rely for their cooling ability on a vapor compression cycle in which a refrigerant liquid such as ammonia, various chlorofluorocarbons, Freon, or a combination of such refrigerants, is caused to evaporate by having the liquid absorb the heat from inside the refrigerator or freezer compartment or from inside the conditioned air space. Typical refrigerants evaporate at extremely low temperatures, and thus can potentially create subfreezing temperatures inside the refrigeration unit. The cooled refrigerant vapor is subsequently circulated through the compressor portion of the unit where both the pressure and temperature are raised, and then through a condenser, thus returning the refrigerant vapor to the liquid state.

As is well known, evaporator coils within refrigeration and freezer units are subject to the buildup of frost or ice. Frost forms when water vapor in the air condenses and deposits on the cooled surfaces of the evaporator coils due to the existence of a cold surface whose temperature is below both the dew point temperature and the freezing point. Ice forms due to a slow transformation of the frost layer into a more dense layer over time, due to a series of complex processes that may involve melting and refreezing of the frost layer and the subsequent seeping of the melt into the pores of the frost sublayers. Ice may also form if supersaturated air exists in the freezer which may result in deposition of these crystals on the coil surface due to a complex convection-dominated phenomenon. Accumulation of frost and ice decreases the efficiency of the evaporator, necessitating removal of the buildup on a periodic basis.

In order to maintain efficient operation of refrigeration units, methods and devices have been developed for removing frost from the cooling coils of evaporator units. In a conventional arrangement, a heating device is disposed proximate to the cooling coils and is used to periodically melt the accumulated ice or frost. The heater is generally controlled by a timer to initiate a defrost cycle at given intervals, in some cases determined electromechanically on the basis of accumulated compressor operating time. Other methods are also known for defrosting the evaporator coils. In all cases, overall energy efficiency and cooling capability of the unit are decreased substantially by the need to include a defrost cycle. In larger units such as walk-in coolers and freezers, automatic defrosting cycles can be impractically lengthy, thus requiring the unit to be completely shut down for defrosting.

For improved energy efficiency in refrigeration units, a need exists to minimize frost buildup on evaporator coils, reducing the necessity for, and duration of, defrost cycles and for shutdowns due to frost and ice buildup.

SUMMARY

The invention provides a trapping device, system and method for trapping, in a refrigeration or freezer unit, airborne water or ice particles that would otherwise accumulate on the evaporator. The trapping device is disposed between the evaporator and the flow of air within the unit directed toward the evaporator.

Accordingly, the invention includes in one aspect a device for trapping airborne water or ice particles in a refrigeration unit. The device includes an evaporator including a plurality of coils, and a trapping device disposed between the evaporator and airflow directed toward the evaporator. The trapping device intercepts liquid water or ice particles that would otherwise accumulate on the plurality of coils. The device can be used within a refrigeration unit such as a freezer, and particularly a walk-in freezer.

In some embodiments of the device, the trapping device of the invention can include a filter having at least one metallic element on a surface or within the media of the filter. The metallic element can be a wire. The device can include a motor for translating the filter relative to the airflow.

The device can further include at least one scraper. The scraper can be spring-loaded.

The device can further include at least one electrical power source, wherein the metallic element is heated by the power source to melt ice on the filter. The electrical power source can be an electrical contact brush. The electrical contact brush can be spring-loaded.

The device can further include at least one control unit. The control unit can include a time clock, a differential pressure controller and/or an optical sensor.

The device can include condensate drainage piping. The condensate drainage piping is preferably heat-traced.

In another aspect of the invention, a system for trapping airborne water or ice particles in a refrigeration unit is disclosed. The system includes an evaporator including a plurality of coils, and a trapping device disposed between the evaporator and airflow directed toward the evaporator. The trapping device intercepts liquid water or ice particles that would otherwise accumulate on the plurality of coils.

In yet another aspect of the invention, a method for trapping airborne water or ice particles in a refrigeration unit is disclosed. The method includes the steps of providing a trapping device interposed between an evaporator comprising a plurality of coils and airflow directed toward the evaporator, and directing the airflow toward the trapping device, wherein the trapping device intercepts liquid water or ice particles that would otherwise accumulate on the plurality of coils. The method can further include the step of actively removing ice that accumulates on the trapping device.

BRIEF DESCRIPTION OF THE DRAWINGS

A fuller understanding of the present invention and the features and benefits thereof will be accomplished upon review of the following detailed description together with the accompanying drawings, in which.

DETAILED DESCRIPTION OF THE PREFERRED EMBODIMENTS

During the operation of refrigeration units, and in particular large units of the walk-in type, especially freezers, chilled air can become supersaturated with an "ice fog" that includes ice particles and water droplets sufficiently small (on the order of microns or less) to remain suspended in the air. Existence of an ice fog is a well recognized phenomenon, although its mechanism of formation remains a subject of research. An ice fog is exacerbated, for example, by opening the door of the refrigeration unit, with resultant influx of warmer, moist air from the exterior. Suspended water and ice particles in the supersaturated environment of refrigeration units can create efficiency problems for the refrigeration unit. By condensing on the coils of evaporators, water droplets from these ice and water particles add to the formation of frost in the system, which must be periodically removed to maintain efficient operation of the system. The faster the rate at which the frost builds up, the more frequently frost removal must be undertaken.

To mitigate this problem, the invention provides in one embodiment a device for trapping airborne water particles before they accumulate on the evaporator, and a system based on this device. The device can be used in newly manufactured refrigeration systems or retrofitted to existing refrigeration systems.

Figure 1:
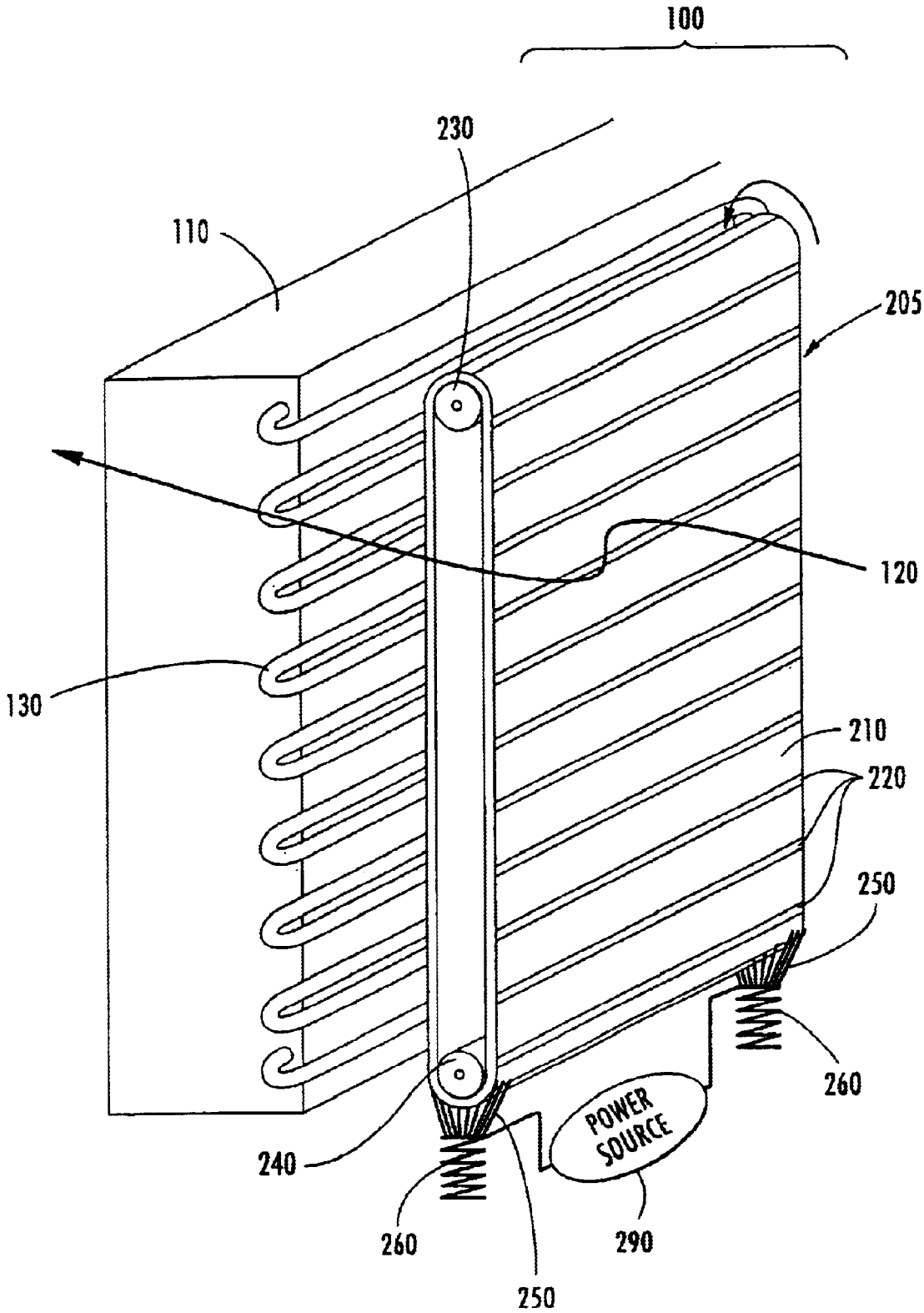
FIG. 1 is a perspective view of a system showing a device for trapping airborne water or ice particles in relation to an evaporator, according to an embodiment of the invention.

FIG. 1 illustrates an embodiment of a refrigeration system 100 showing a trapping device 205 of the invention and an evaporator 110. The system 100 also includes a condensing unit (not shown) and refrigerant lines (not shown). The trapping device 205 is interposed between the evaporator 110 and the flow of air 120 directed toward the evaporator 110. Preferably the width and height of the trapping device 205 and the evaporator 110 of the system 100 are similarly proportioned. However, the trapping device 205 may be of any size or shape adequate to screen the evaporator coils 130 from airborne water particles in the incoming airflow 120. Although a preferred embodiment is described herein in the context of a freezer, the principle of operation of the trapping device 205 of the invention is applicable to any refrigeration unit that includes an evaporator subject to deposition of frost on the coils under conditions of supersaturation of the air with suspended ice crystals or water droplets.

During normal operation of refrigeration units such as walk-in freezers, a flow of air 120 is directed toward the evaporator 110, typically by a fan (not shown). The trapping device 205 intercepts suspended water and ice particles contained in the air directed toward the evaporator 110 before these particles have an opportunity to contact and freeze on the coils 130 of the evaporator 110. The trapping function can be performed by a filter 210 that includes at least one metallic element 220 suitably positioned for trapping the water particles, for example, by condensation and freezing onto the surface of the metallic elements 220. The metallic elements 220 of the filter 210 are designed to "frost up" during operation of the refrigeration unit. Thus, the metallic elements 220 of the filter 210 present a preemptive, or alternative site, other than the evaporator coils 130, for preferential deposition of a substantial portion of the frost which would otherwise accumulate on the evaporator coils 130 from water particles suspended in the air stream 120. The suspended water particles can also accumulate on the filter 210.

The trapping device 205 of the invention can be secured in position proximate to the evaporator coils 130 by any suitable attachment mechanism. For example, the trapping device 205 can be positioned within an open framework or other suitable housing (not shown) that can be fastened to the coils 130 or other component of the evaporator 110, for example using bolts or screws.

The metallic elements 220 of the filter 210 can be of any material, shape and construction suitable for acting as a site of deposition of airborne water droplets or ice crystals. Preferably, a plurality of metallic elements 220 is included on or within the filter 210. In the embodiment of the trapping device 205 shown in FIG. 1, the metallic elements 220 are fibers, such as nichrome wires, oriented perpendicularly to the long axis of the filter 210. When constructed as fibers, the metallic elements 220 can be fibers of any suitable length, width, shape, thickness, and metal composition. Alternatively, the metallic elements 220 need not be in the form of wires, and can be constructed in any other shape appropriate for trapping of airborne water particles or ice crystals. Combinations of different types of metallic elements 220, such as wires and metallic elements of other shapes are also within the invention. In some embodiments, the metallic elements 220, or a portion thereof, may be embedded within the matrix of the filter 210.

The matrix of the filter 210 can be made of any suitable filter material, provided that it allows adequate airflow therethrough to the evaporator 110. The mesh size of the filter 210 can be any size suitable for the purpose. An exemplary material for the filter 210 is layered fiberglass of the type typically used for commercial air conditioning filters. Where reusability of the filters 210 is desired, the filter matrix can be constructed of a washable mesh material formulated, for example, from plastic.

The filter 210 can be movable in relation to the air flow 120. For example, in the embodiment of the trapping device 205 illustrated in FIG. 1, interception of airborne water droplets or ice particles can be achieved by revolving the filter 210 using upper and lower rollers 230 and 240, respectively. By revolving the filter 210, a new surface is continuously exposed to the air flow 120 and thus is available for more efficient capture of suspended water droplets and ice particles and deposition of frost on the metallic elements 220. Concurrently, as described below, the rotation of the filter 210 can be advantageously utilized to remove accumulated frost deposited on the surface of the filter 210 during the previous cycle of exposure to the air flow 120.

FIG. 1 illustrates one exemplary embodiment of a device 100 of the invention including a revolving filter 210 and an electrical power source in contact with the filter 210. In this embodiment, the electrical power source is a pair of standard electrical contact brushes 250. The position of an electrical contact brush 250 relative to the filter 210 can be flexible. For example, an electrical contact brush 250 can be held under tension against the filter 210. In the device 100 shown, the electrical contact brushes 250 are spring-loaded by attachment to springs 260.

During active operation of the trapping device 205, the filter 210 rotates on the rollers 230 and 240. Once per cycle of rotation, the metallic elements 220 of the filter 210 come into contact with the electrical contact brushes 250. In some embodiments of the invention (described below) portions of the metallic elements 220 are embedded within the matrix of the filter 210, in which case suitably positioned extensions of the metallic elements 220 make contact with the electrical contact brushes 250.

Contact of one or more metallic elements 220 with the electrical contact brushes 250 completes an electrical circuit which allows power supply 290 to flow current through the metallic elements 220, causing them to heat up. Heating of the metallic elements 220 melts any adherent frost, which then drains from the bottom of the filter 210 to a gravity fed drain line (described below). Upon movement of the metallic elements 220 away from the electrical contact brushes 250, the metallic elements 220 rapidly lose heat, once again chilling to the ambient temperature within the interior of the refrigeration unit.

From the standpoint of energy conservation, it is an advantageous feature of the design of the trapping device 205 that the metallic elements 220, despite their continuous use during the operation of the device 100, are heated only briefly during the cycle of operation. As described above, the metallic elements 220 carry out their primary "cold" function in the chilled state existing in the interior of the refrigeration unit, serving to trap and freeze airborne water and ice particles. In the preferred embodiment illustrated in FIG. 1, the metallic elements 220 are subjected to heating only once per rotational cycle, i.e., during their brief period of "hot function," brought about by contact with the electrical contact brushes 250. In this way, energy use is minimized. Moreover, the metallic elements 220 have a thermal mass that is a small fraction of that of the coils 130 of the evaporator 110.

Whereas only one site of heating is illustrated in the device 100 of FIG. 1, it will be appreciated, however, that more than one site of contact of the metallic elements 220 with an electrical source could be provided at a given point in time without departure from the overall concept of minimizing the duration of the period of "hot function" vs. "cold function" of the metallic elements 220. Moreover, although the above-described embodiment includes a revolving filter 210, those of ordinary skill in the art will appreciate that many mechanisms can be envisioned for driving movement of the filter 210.

Figure 2:
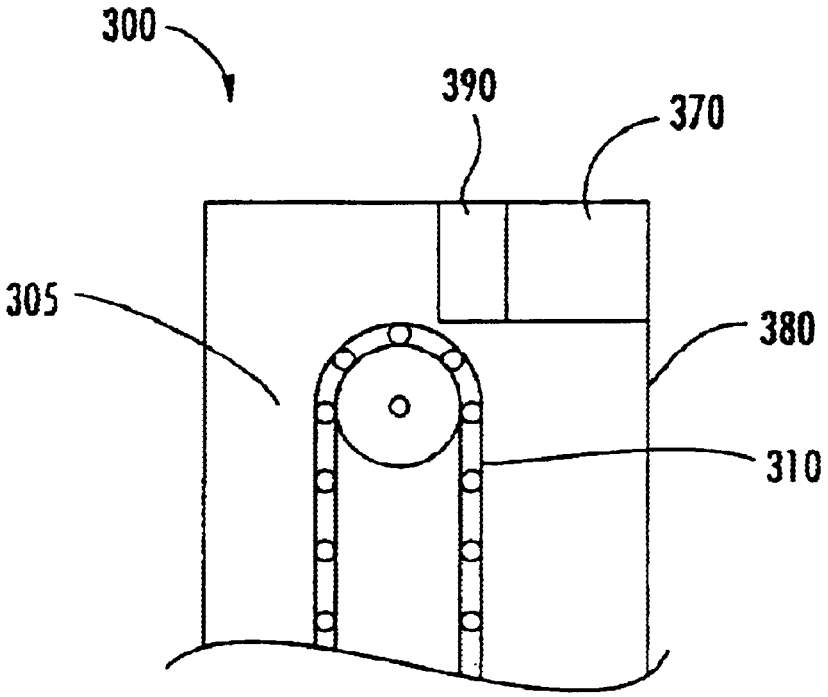
FIG. 2 is a schematic elevation view of a device for trapping airborne water or ice particles including a motor and a control unit, according to an embodiment of the invention.

In embodiments of the devices of the invention incorporating revolving or otherwise moving filters, movement of the filters (for example on rollers 230 and 240, as illustrated in FIG. 1) can be driven by a motor. FIG. 2 shows a device 300 of the invention including a trapping device 305 with a filter 310 and a motor 370 disposed within a housing 380 positioned external to the trapping device 305. The motor 370 can be operably connected to the movement mechanism in any suitable manner.

The device 300 of the invention can be further configured to include at least one control unit 390 for control of various operations of the device 300. Suitable control devices are well known to those having ordinary skill in the refrigeration, defrosting and air conditioning arts, and can include, among others, a time clock, a differential pressure controller, and/or an optical sensor. Such devices can be used, for example, to automatically activate a motor for driving movement of the filter 310. As is well known, activation can be initiated by these devices on the basis of various parameters, for example, duration of compressor operation, changed pressure conditions within the refrigeration unit, or optical detection of an exceeded level of frost accumulation.

Figure 3:
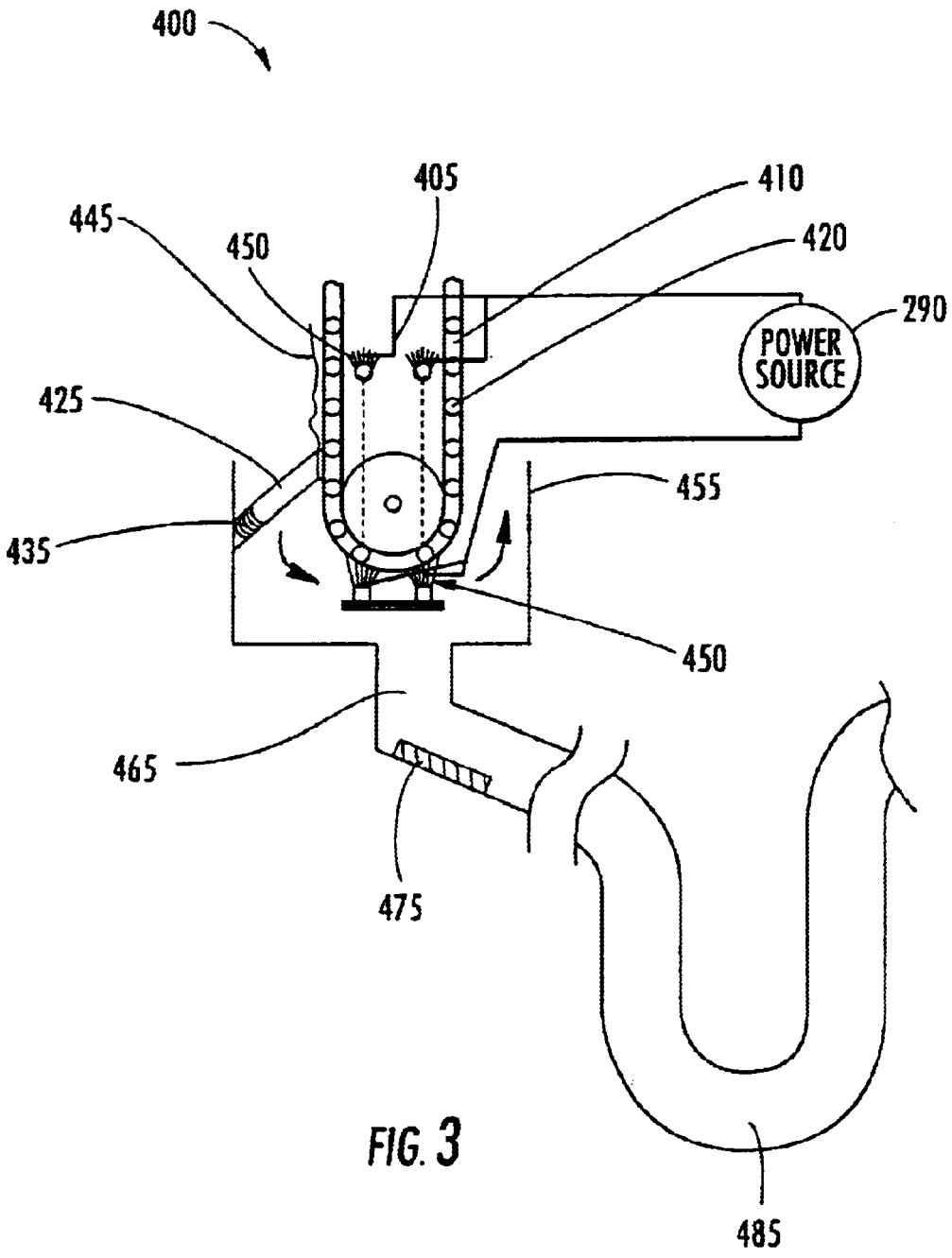
FIG. 3 is an elevation view of a trapping device that includes an electrical power source, a scraper, a condensate collection pan and drainage piping, according to an embodiment of the invention.

Some embodiments of the devices of the invention can include one or more structures for removing frost from the filter of the trapping device. Referring to FIG. 3, device 400 includes a trapping device 405 with a filter 410 in which metallic elements 420 are embedded in the matrix of the filter 410. The device 400 includes a structure for removal of frost in the form of a scraper 425 positioned to be in contact with the surface of the filter 410 exposed to the air flow. The device 400 also includes a condensate collection pan 455 for capture and drainage of the removed frost and water.

In the operation of the device 400, the scraper 425 functions to mechanically remove the frost 445 that has built up on the filter 410 after it has been exposed to the airflow (not shown). Scraping is accomplished by positioning the scraper 425 so as to be in contact with the outer surface of the moving filter 410, or proximate thereto. In the embodiment of the device 400 shown, the scraper 425 is spring-loaded by attachment with a spring 435 to a housing, such as a condensate collection pan 455. Any suitable shape, size and material can be used in the manufacture of a component designed to accomplish the function of the scraper 425 of the device 400. As an alternative to stationary scrapers, either rigidly affixed or flexibly attached to a housing such as by springs, it will be apparent to those skilled in the art that the design of the devices of the invention could also encompass, for example, a trapping device with a stationary filter and one or more moving scrapers.

Removal of accumulated frost 445 from the filter 410 can be further facilitated by including a source of electrical power 290, as described above, to periodically heat the metallic elements 420 of the filter 410. Frost removal can be effected by heating alone, or preferably in combination with the mechanical action of one or more scrapers 425. The device 400 shown in FIG. 3 includes both a scraper 425 and electrical contact brushes 450. Electrical contact brushes 450 are shown contacting metallic elements 420 which completes the closed circuit which permits source of electrical power 290 to heat the metallic elements 420. In embodiments such as device 400 in which the metallic elements 420 are included within the matrix of the filter 410, portions of the metallic elements 420 can extend beyond the edges of the filter 410, to make contact with the electrical contact brushes 450.

For optimal energy conservation in embodiments incorporating rotating filter mechanisms, such as the device 400 shown in FIG. 3, the electrical contact brushes 450 or other suitable electrically conductive surfaces connected to the electrical power source 290 should generally be positioned close to the site of scraping of the filter 410, i.e., closely "downstream" of the scraper 425 in the direction of rotation (shown by arrows) of the filter 410. According to such an arrangement, the majority of the deposited frost 445 is eliminated mechanically by the scraper 425, thereby minimizing the energy required to melt the remaining adherent frost by heating the metallic elements 420 by contact with the electrical contact brushes 450.

The embodiment shown as device 400 further includes a condensate collection pan 455, which can be of any appropriate size, shape and material. The condensate collection pan 455 can be connected to condensate drainage piping 465 used for directing the flow of frost and/or water condensate removed from the filter 410 by gravity, or during an active cleaning process such as by the above-described scraping of the filter 410 and/or by heating of the metallic elements 420. The condensate drainage piping 465 can include a heat-trace 475, preferably on the exterior of the refrigeration unit, to facilitate free flow and removal of collected condensate. As is well known in the art, a condensate trap 485 can be included in the condensate drainage piping 465, preferably exterior to the housing of the refrigeration unit.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A device for trapping airborne water or ice particles in a refrigeration unit, comprising:

a trapping device disposed between an evaporator comprising a plurality of coils and airflow directed toward said evaporator, said trapping device intercepting liquid water or ice particles that would otherwise accumulate on said plurality of coils, said trapping device comprising a bulk filter material, said bulk filter material providing airflow therethrough to said evaporator, wherein at least one metallic element is disposed on a surface or within said filter material, and a motor for rotating said trapping device.

2. The device of claim 1, wherein said refrigeration unit is a freezer.

3. The device of claim 2, wherein said freezer is a walk-in freezer.

4. The device of claim 1, wherein said metallic element is a wire.

5. The device of claim 1, further comprising an electrical contact brush, wherein rotation of said trapping device over said contact brush results in electrical contact between said metallic element and said contact brush.

6. The device of claim 5, further comprising at least one scraper disposed on either side of said electrical contact brush for removing ice from said trapping device.

7. The device of claim 5 further comprising at least one electrical power source, wherein said metallic element is heated by said power source to melt ice on said filter into water when said contact brush is in electrical contact with said metallic element.

8. The device of claim 5, wherein said electrical contact brush is spring-loaded.

9. The device of claim 1, further comprising at least one control unit coupled to said motor for controlling when to initiate rotation of said device, said control unit being at least one selected from the group consisting of a time clock, a differential pressure controller and an optical sensor.

10. The device of claim 7, further comprising condensate drainage piping, said piping receiving and transferring away said water melted by said heated metallic element.

11. The device of claim 10, wherein said condensate drainage piping is heat-traced for preventing re-freezing of said water.

12. A refrigeration system comprising:

an evaporator including a plurality of coils, and a trapping device disposed between said evaporator and airflow directed toward said evaporator, said trapping device intercepting liquid water or ice particles that would otherwise accumulate on said plurality of coils, said trapping device comprising a bulk filter material, said bulk filter material providing airflow therethrough to said evaporator, wherein at least one metallic element is disposed on a surface or within said filter material, and a motor for rotating said trapping device.

13. A method for trapping airborne water or ice particles in a refrigeration unit, comprising the steps of:

providing a trapping device interposed between an evaporator comprising a plurality of coils and airflow directed toward said evaporator, and directing said airflow toward said trapping device, wherein said trapping device intercepts liquid water or ice particles that would otherwise accumulate on said plurality of coils, said trapping device comprising a bulk filter material, said bulk filter material providing airflow therethrough to said evaporator, wherein at least one metallic element is disposed on a surface or within said filter material, and rotating said trapping device during at least one interval of time during operation of said device.

14. The method of claim 13, wherein said rotating step comprises:

rotating said trapping device into a position which completes an electrical circuit including said metallic element, and flowing electrical current through said metallic element to melt ice that accumulates on said trapping device.

15. The device of claim 1, wherein said bulk filter material comprises layered fiberglass.

16. The method of claim 13, wherein said rotating step is initiated following receipt of a signal from a control unit, said control unit selected from the group consisting of a time clock, a differential pressure controller and an optical sensor.

* * * * *